United States Patent [19]

Kavis

[11] 4,302,013

[45] Nov. 24, 1981

[54] PUZZLE ASSEMBLY AND DISPLAY APPARATUS

[76] Inventor: George Kavis, 355 E. 146th St., Harvey, Ill. 60426

[21] Appl. No.: 152,771

[22] Filed: May 23, 1980

[51] Int. Cl.[3] ..... A63F 9/10

[52] U.S. Cl. ..... 273/157 R; 206/315 R

[58] Field of Search ..... 273/157 R; 206/315 R, 206/579

[56] References Cited

U.S. PATENT DOCUMENTS

| | | | |
|---|---|---|---|
| 864,254 | 8/1907 | Perkins | 273/148 A UX |
| 1,987,496 | 1/1935 | Springborn | 273/157 R |
| 4,111,425 | 9/1978 | Lathrop | 273/157 R |

FOREIGN PATENT DOCUMENTS

| | | | |
|---|---|---|---|
| 1175447 | 12/1969 | United Kingdom | 273/157 R |
| 1181232 | 2/1970 | United Kingdom | 273/157 R |

*Primary Examiner*—Anton O. Oechsle

*Attorney, Agent, or Firm*—Sabin C. Bronson

[57] ABSTRACT

An assembly and display apparatus for jig-saw puzzles comprises; a storage tray for storing unfitted puzzle pieces; an assembly tray located in spaced relation to the storage tray and having a surface on which the puzzle is assembled, the surface having a plurality of perforations in which stops can be inserted to prevent the assembled puzzle from moving along the surface; and a transparent display tray located in spaced relation to the assembly tray and being capable of co-operating with the stops in the perforations to hold the assembled puzzle in place. The storage tray, assembly tray and display tray are designed so as to be capable of being held together to form one unit.

9 Claims, 5 Drawing Figures

FIG. 1
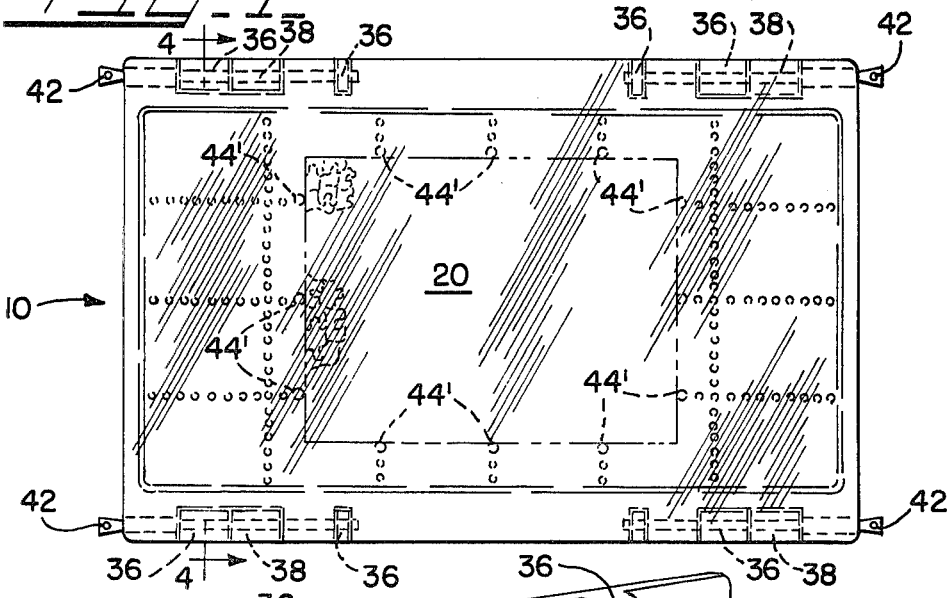
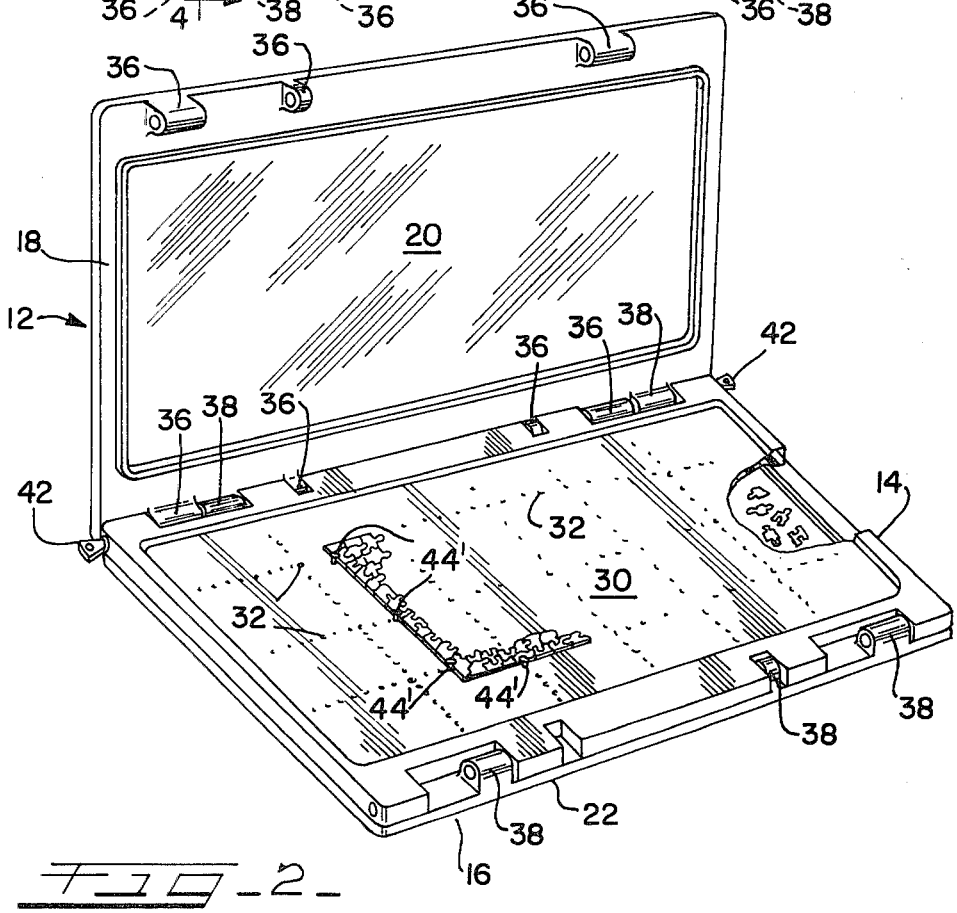
FIG. 2

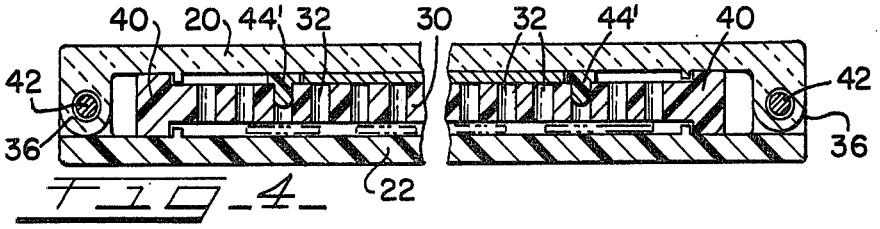
FIG. 4
FIG. 3
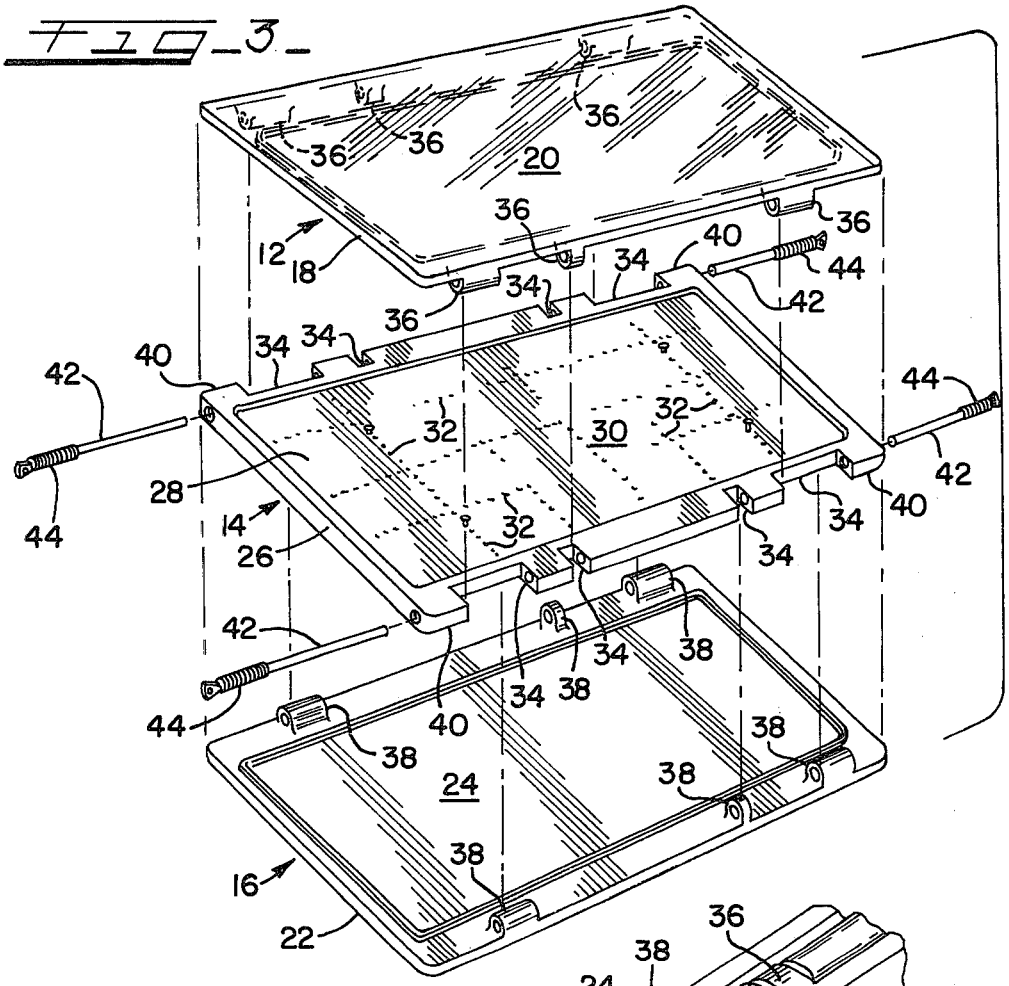
FIG. 5

PUZZLE ASSEMBLY AND DISPLAY APPARATUS

BACKGROUND AND SUMMARY OF THE INVENTION

The present invention relates to the assembling and displaying of jig-saw puzzles. More particularly, the invention relates to a compact and portable apparatus useful to both assemble and display at least one jig-saw puzzle.

The piecing together of jig-saw puzzles can be a very interesting hobby. Working on assembling such puzzles is a pleasant way to while away one's leisure time. In addition, the assembled puzzle often depicts a scene which is worthy of display. Complex jig-saw puzzles often cannot be completely assembled at one sitting. The work area used to assemble such puzzles may be required for other purposes. Also, the person or persons working on the puzzle may want to assemble different portions of the puzzle at different locations. For example, he or she may start the puzzle at home and, because of time constraints, want to finish the puzzle in a different environment, i.e., on vacation.

Once the puzzle is completed, it may be desired to display the finished product. Prior art methods of assembling puzzles for display, e.g., gluing the puzzle to a back-up board to hold it together and flat, often cause damage to the puzzle.

Therefore, one object of this invention is to provide an improved apparatus for assembling jig-saw puzzles.

Another object of this invention is to provide an improved apparatus for displaying assembled jig-saw puzzles.

A further object of the invention is to provide an improved apparatus to both assemble and display jig-saw puzzles.

An additional object of the invention is to provide an improved apparatus on which more than one jig-saw puzzle can be assembled. These and other objects and advantages of the present invention will become apparent hereinafter.

An improved jig-saw puzzle assembly display device has now been discovered. The apparatus comprises a combination of three tray elements; a storage tray; an assembly tray; and a display tray, all of which are configured to be capable of being held together, e.g., to form a single unit. The storage tray is capable of storing unfitted pieces of the jig-saw puzzle. The assembly tray is located in spaced relation to the storage tray and has a surface on which the jig-saw puzzle is assembled, i.e., on which the puzzle pieces are properly fitted together. This surface has a plurality of perforations so that a plurality of individual stops may be inserted therein to prevent the assembled puzzle from moving along the surface. The display tray is at least partially transparent to allow the assembled puzzle, e.g., on the surface of the assembly tray, to be displayed. This display tray is located in spaced relation to the assembly tray so as to be capable of co-operating with the stops in the perforations to effectively immobilize the assembled puzzle, e.g., for display purposes.

The apparatus of the present invention provides for convenient storing, assembling and displaying of jig-saw puzzles. The unit may be hand carried and, therefore, is portable from one location to another. Thus, a complex puzzle may be assembled over a prolonged period of time without tying up a large work area for all that time. Further, the present system allows the assembled puzzle to be effectively secured in place, even though the puzzle is moved from location to location and displayed.

In a more preferred embodiment, the storage tray and display tray are interchangeable. That is, the configuration of the storage tray is substantially identical to that of the display tray. Of course, in this embodiment, the storage tray (and preferably also the display tray) which are at least partially transparent are made of a material which is resistant to scratches from unfitted puzzle pieces sliding on the storage tray.

This interchangeability feature is particularly advantageous, although not necessary, in another embodiment of the present system in which the assembly tray includes a second surface opposite the surface described above. This second surface, on which a different jig-saw puzzle is assembled, includes a plurality of perforations so that second stop elements may be inserted therein to present the different assembled puzzle pieces from moving along the second surface. In this embodiment, the storage tray, preferably at least partially transparent, is located in spaced relation to the assembly tray so as to be capable of co-operating with the second stop elements to effectively immobilize the different assembled puzzle. The storage tray is preferably at least partially transparent to allow the different assembled puzzle pieces to be displayed. In this embodiment, two different jig-saw puzzles may be in assembled form at the same time. The user of the unit can choose which puzzle to display or, e.g., by hanging the unit in the middle of a room from the ceiling, can display both puzzles. In any event, this feature provides added flexibility.

The surface and second surface of the assembly tray are preferably opaque, for example, having a color or colors to highlight the color or colors of the assembled puzzle.

The storage tray, assembly tray and display tray are preferably each capable of pivotable movement with respect to the other trays. This allows for easy access to both the assembly tray and the storage tray. In one particularly preferred embodiment in which each of the trays is substantially rectangular in configuration, such pivotable movement is achieved by employing two pivot rods which are capable of being inserted near opposing corners of the rectangular configuration defining the assembly tray.

Preferably, the present apparatus further comprises a fastening mechanism to hold the storage tray, assembly tray and display tray together, e.g., as a unit. One particularly preferred fastening mechanism involves a plurality of pivot rods, more preferably four pivot rods, each of which is inserted through one or more portions of each of the trays. If, as preferred, the trays are substantially rectangular, the fastening mechanism, for example, includes four pivot rods capable of being located near each of the corners of the rectangle defining the assembly tray. Using such a fastening mechanism, the present unit is effectively held together.

These and other aspects and advantages of the present invention are set forth in the following detailed description and claims particularly when considered in conjunction with the accompanying drawings in which like parts bear like reference numerals. In the drawings:

BRIEF DESCRIPTION OF THE DRAWINGS

FIG. 1 is a top elevational view of one embodiment of the present apparatus.

FIG. 2 is a front side view in perspective of the embodiment shown in FIG. 1 showing one of the trays in an upright position.

FIG. 3 is a front side, exploded view in perspective of the embodiment shown in FIG. 1.

FIG. 4 is a cross sectional view taken along line 4—4 of FIG. 1.

FIG. 5 is a partial top side view in perspective of a portion of the embodiment shown in FIG. 1.

DESCRIPTION OF THE PREFERRED EMBODIMENT

Referring to the drawings, the embodiment of the present display assembly apparatus illustrated, shown generally at 10, includes a top tray 12, middle tray 14 and lower tray 16. Top tray 12 is rectangular in configuration and includes top rim 18, which may be opaque, which surrounds top window 20, which is made of a transparent material, e.g., glass, durable transparent plastic and the like. Similarly, lower tray 16 is rectangular in configuration and includes lower rim 22, which may be opaque, which surrounds lower window 24, which is made of a transparent material, e.g., glass, durable transparent plastic and the like. In fact, top tray 12 and lower tray 16 are interchangeable. That is, top tray 12 may be used in place of lower tray 16 and lower tray 16 may be used in place of top tray 12.

Middle tray 14 includes rectangular shaped middle rim 26, which may be opaque, which surrounds assembly element 28, which is preferably opaque. Assembly element 28 includes assembly surface 30 which includes numerous perforations 32, which preferably do not extend through assembly element 28. Assembly element 28 also includes a second assembly surface with numerous perforations which, again, preferably do not extend completely through assembly element 28. The size, shape and function of second assembly surface and its perforations are completely analogous to that of assembly surface 30 and perforations 32 so that what is said relative to assembly surface 30 and perforations 32 applies equally to the second assembly surface and its perforations.

As can be seen most clearly in FIG. 3, middle rim 26 includes a series of cut-outs 34 in the opposing length wise portions of middle rim 26. Top rim 18 includes a series of top hollow projections 36 which are designed to fit into one-half of cut-outs 34. Similarly, lower rim 22 includes a series of lower hollow projections 38 which are designed to fit into the other half of cut-outs 34. The portions of middle rim 26 located adjacent to cut-outs 34 are also hollowed out, with the portions 40 nearest each of the corners of middle rim 26 being hollowed out with a threaded hole.

Display assembly apparatus 10 is configured so that when top hollow projections 36 and lower hollow projections 38 are fitted into cut-outs 34, threaded pivot rods 42 can be passed through corner portions 40, top hollow projections 36 and lower hollow projections 38. Each of threaded pivot rods 42 includes a threaded segment 44 which can be matingly received by the threads with each of the corner portions 40. With top hollow projections 36 and lower hollow projections 38 fitted into cut-outs 34 and threaded segments 44 of threaded pivot rods 42 matingly received into corner portions 40, top tray 12, middle tray 14 and lower tray 16 are effectively locked together.

Assembly display apparatus 10 may be used as follows. Assembly display apparatus 10 is laid flat on a table, desk, bench or the like and two threaded pivot rods 42 which were inserted along the same length wise portion of middle rim 26 are removed, as shown best in FIG. 2. The two threaded pivot rods 42 which remain in place, as shown in FIG. 2, provide that top tray 12, middle tray 14 and lower tray 16 are pivotally moveable relative to each other along a line formed by the longitudinal axes of the two threaded pivot rods 42 which remain in place. (Of course, if desired, trays 12, 14 and 16 can be completely separated from each other, by removing all four threaded pivot rods 42 from their inserted positions).

Such pivotal movement allows the user of assembly display apparatus 10 to move display tray 12 to an upright position, relative to the other trays, thereby exposing assembly surface 30, as shown in FIG. 2. Middle tray 14 is pivoted up thereby exposing lower window 24. The unfitted pieces of jig-saw puzzle to be assembled on assembly surface 30 are placed on lower window 24. The user commences assembling the jig-saw puzzle by selecting unfitted pieces from lower window 24 and placing them in their proper fitted position on assembly surface 30. The user must exercise care in pivoting up middle tray 14 (in taking additional unfitted pieces from lower window 24) to avoid disturbing the already fitted portion of the puzzle on assembly surface 30.

This puzzle assembly procedure is continued until the puzzle is completely assembled. At this point, the assembled puzzle may be moved along assembly surface 30 to a position, e.g., a substantially central position, on assembly surface 30 as desired by the user. In any event, once the assembled puzzle is properly located on assembly surface 30, a plurality of button pins 44' are inserted into perforations 32 in assembly surface 30 directly adjacent the perimeter of the assembled puzzle, as shown in FIG. 1. Button pins 44', act to prevent the assembled puzzle from moving along assembly surface 30.

With button pins 44' in place, top tray 12 is moved down from the upright position shown in FIG. 2 toward middle tray 14 so that the two threaded pivot rods 42 which had been removed can be reinserted into corner portions 40 and projections 36 to lock trays 12, 14 and 16 together. With trays 12, 14 and 16 in such locked position, button pins 44', assembly surface 30, and top tray 12 co-operate to effectively inhibit the movement of the assembled puzzle regardless of the position of assembly display apparatus 10. Thus, the assembled puzzle may be displayed through top window 20.

An alternate use of assembly display apparatus 10 involves the situation where the complete puzzle is not assembled at one time and the partially assembled puzzle must be stored. In this instance, button pins 44' are placed in perforations 32 in assembly surface 30 directly adjacent the perimeter of the assembled portion of the puzzle, as shown in FIG. 2. Trays 12, 14 and 16 are locked together, thus effectively preserving the assembled portion of the puzzle for further assembly at a future time.

An additional alternate involves assembling a different puzzle on the surface of assembly element 28 directly opposite, i.e., on the reverse side of assembly surface 32. In this situation, and assuming that there is already a puzzle assembled on assembly surface 30, assembly display apparatus 10 is laid flat, two threaded pivot rods 42 are removed (as indicated previously) and lower tray 16 is pivoted up to an upright position thereby exposing the underside of assembly surface 30. Middle tray 14 must not be moved relative to top tray 12 to avoid disturbing the assembled puzzle on or near assembly surface 30. Therefore, the unfitted puzzle piece storage feature of assembly display apparatus 10 can not be used in this situation.

The user commences to assemble the different puzzle on the underside of assembly element 28. After assembly is complete the different puzzle is properly placed and fixed on the underside surface of assembly element 28 using button pins 44' in perforations in the underside surface directly adjacent to the perimeter of the assembled puzzle. Trays 12, 14 and 16 are locked together thereby providing for display of the assembled different puzzles through lower window 24. Thus, two separate jig-saw puzzles can be available for display at the same time using assembly display apparatus 10.

While this invention has been described with respect to various specific embodiments and example, it is to be understood that the invention is not limited thereto and that it can be variously practiced within the scope of the following claims.

Having thus described my invention, what I claim and desire to secure by Letters Patent is:

1. An apparatus useful for assembling and displaying at least one jig-saw puzzle comprising; storage tray means capable of storing unfitted pieces of said jig-saw puzzle; assembly tray means located in spaced relation to said storage tray means and having a surface on which said jig-saw puzzle is assembled; said surface having a plurality of perforations so that stop means may be inserted therein to prevent said assembled puzzle from moving along said surface; display tray means being at least partially transparent to allow said assembled puzzle to be displayed and being located in spaced relation to said assembly tray means so as to be capable of cooperating with said stop means in said perforations to effectively immobilize said assembled puzzle, and fastening means to hold said storage tray means, said assembly tray means and said display tray means together.

2. The apparatus of claim 1 wherein said storage tray means and said display tray means are interchangeable.

3. The apparatus of claim 1 wherein said assembly tray means is at least partially opaque.

4. The apparatus of claim 1 wherein said storage tray means, said assembly tray means and said display tray means are each capable of pivotal movement with respect to said other two tray means.

5. The apparatus of claim 1 wherein said assembly tray means includes a second surface opposite said surface, on which a different said jig-saw puzzle is assembled, said second surface having a plurality of perforations so that second stop means may be inserted therein to prevent said different assembled puzzle from moving along said second surface and said storage tray means being located in spaced relation to said assembly tray means so as to be capable of co-operating with said second stop means in said perforations to effectively immobilize said different assembled puzzle.

6. The apparatus of claim 5 wherein said storage tray means is at least partially transparent to allow said different assembled puzzle to be displayed.

7. The apparatus of claim 1 wherein said fastening means includes a plurality of pivot rods each of which is inserted through at least one portion of the storage tray means, assembly tray means and display tray means.

8. The apparatus of claim 7 wherein each of said tray means is substantially rectangular in configuration and said fastening means includes four pivot rods located near each of the corners of the rectangle defining said assembly tray means.

9. The apparatus of claim 8 wherein at least two of said pivot rods are capable of being inserted near opposing corners of said rectangle so that when said two pivot rods are inserted each of said tray means is capable of pivotable movement with respect to said other two tray means.

* * * * *